United States Patent [19]

Scott

[11] 4,166,944

[45] Sep. 4, 1979

[54] WATER HEATER CONTROL SYSTEM

[76] Inventor: Kenneth W. Scott, 601 9th St., Coronado, Calif. 92118

[21] Appl. No.: 818,967

[22] Filed: Jul. 25, 1977

[51] Int. Cl.[2] ..... H05B 1/02; F24H 1/00; G05D 23/00

[52] U.S. Cl. ..... 219/330; 126/351; 126/362; 219/334; 219/508; 236/47

[58] Field of Search ..... 126/351, 374, 361, 362; 236/47, 20; 219/327-331, 334, 337, 508, 310, 312, 515; 137/341

[56] References Cited

U.S. PATENT DOCUMENTS 4,016,402 4/1977 Scott ..... 19/334

*Primary Examiner*—A. Bartis

[57] ABSTRACT

A water heater control system is provided to lower the temperature to which hot water is heated during periods of low use, and raise the temperature back up during periods of peak demand. The unit described herein is adapted for use on a recirculating hot water system used in apartment buildings and includes a first thermoswitch disposed on the outflow pipe from the hot water tank which feeds this recirculating system. This pipe is hotter during periods of low use because the heater is adequate to provide continuous supply of very hot water which has not been drained by tenant use. Thus this thermoswitch is directly wired to a thermostat control to reduce the heater temperature when the thermoswitch is hot. A second switch is mounted on the cold water inflow supply pipe into the water heater, this thermoswitch being wired in series with the first thermoswitch, this switch being closed only when it is cooled, similar to the first thermoswitch, so that when the inflow supply pipe is cool due to high usage and thus continuous input of cold water, the second thermoswitch closes, which permits the first thermoswitch to control the system. During quiescent periods of low use, the inflow warms due to conduction from the hot water tank, thus opening the second thermoswitch and making the first switch ineffective.

4 Claims, 2 Drawing Figures

WATER HEATER CONTROL SYSTEM

BACKGROUND OF THE INVENTION

The present device is an improvement of a water heater control system patented Apr. 5, 1977, U.S. Pat. No. 4,016,402 by the applicant of the instant invention.

The purpose of the control system in that device was to raise the setting of a thermostat which controlled the water heater during periods of high water use, and lower the thermostat during times of low hot water demand, such as in the night and early morning hours.

The advantage of adjusting the temperature of this fashion is two-fold. First, the energy dissipated as waste from the system is of course reduced if the temperature is lower. The second advantage, which although perhaps being secondary from an ecological standpoint is paramount in economics, is the considerable reduction of the rate of boiler scale formation, which rises dramatically with an increased temperature over 100°. Ordinarily, the boiler scale is in the end of the nemesis of most water heater systems, and inefficiency in heat transfer caused by the scale creates additional heat losses prior to the complete disutility of the unit.

The above referenced unit is quite advantageous compared to existing hot water heating control systems (ordinarily simply a thermostat), but under certain circumstances was subject to the following operational limitation. During periods of low hot water demand, the thermoswitch of that device would respond to the warm temperature in the recirculatory system by lowering the thermostat, which it should properly do. However, with the thermostat in the lowered mode the temperature in the recirculatory system would drop just as it does during periods of high water use (although much slower), and eventually would trigger the thermoswitch just as would low temperature caused by high water demand, thus elevating the thermostat in the middle of the night in response to a signal other than low water usage.

SUMMARY OF THE INVENTION

The present invention resolves the above cited problem of temperature rise during period of non-use essentially by placing a second thermoswitch wired in series with the first and mounted to an inflow (cold water supply) line or pipe adjacent the hot water reservoir. This switch is programmed to open above a certain temperature and close below said temperature, the temperature being controlled by conduction in the water within the inflow pipe from the hot water tank. It can thus be seen that under static, no-draw conditions, heat would be conducted into the inflow pipe from the hot water reservoir, opening the second thermoswitch and preventing the first thermoswitch from controlling the thermostat. Thus, the second thermoswitch would have a veto function. As the second thermoswitch would be in its cold mode only during a period of water usage, the undesired midnight temperature rise would be thus eliminated.

A second improvement of the new system over the old is the provision for direct control of gas burner or electric heating element with a valve or switch, respectively, as opposed to the indirect control accomplished through an existing thermostat.

DETAILED DESCRIPTION OF THE PREFERRED EMBODIMENT

Figure 1:
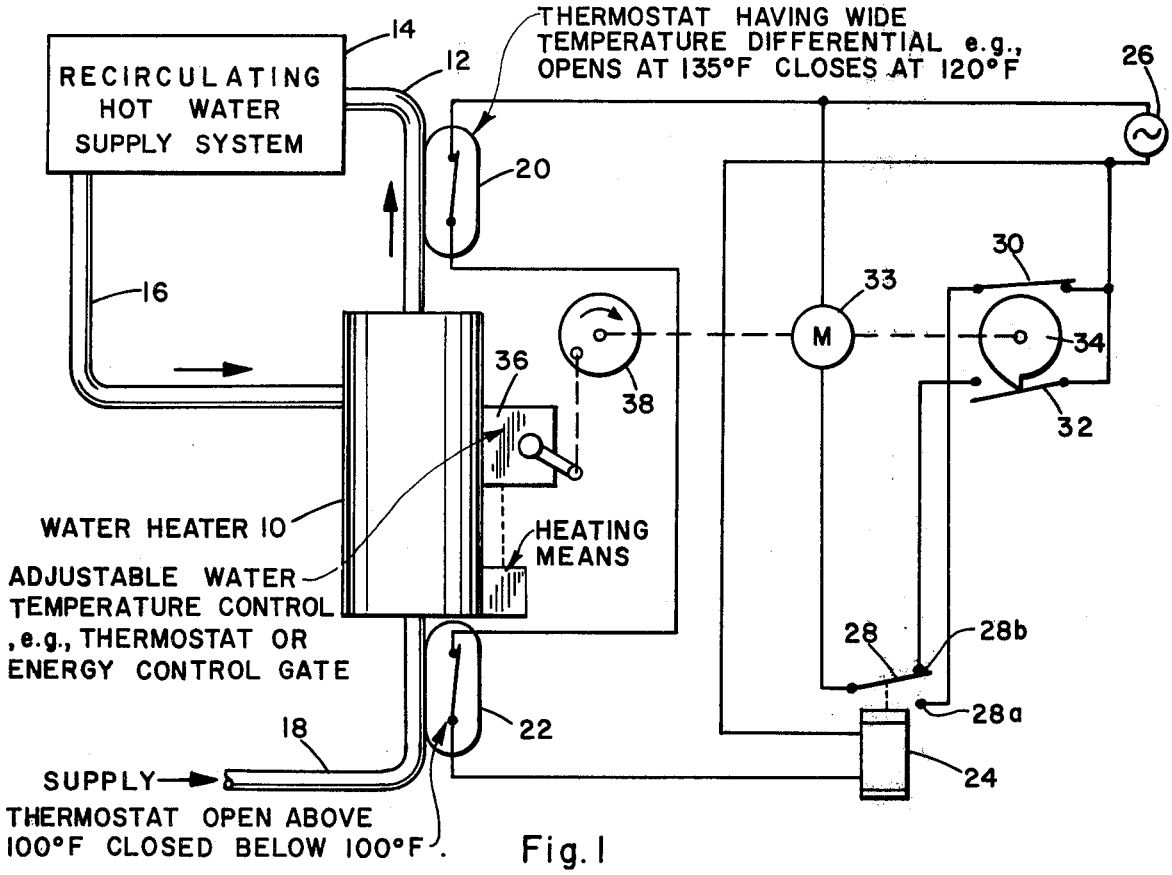
FIG. 1 is a diagrammatic view of the system.

The system is diagrammatically illustrated in FIG. 1 in which 10 represents the heater itself, having an outflow hot water pipe 12 connected through recirculating system 14 to return line 16. It will be understood that the invention is equally operable on a non-recirculating system such as would be used in an individual single family residence. In this latter instance, the temperature at the outflow line rises during periods of low usage due to conduction from the water tank, and decreases during periods of high use so that the temperature characteristics of the outflow line as a function of level of hot water demand is identical for both recirculating and non-recirculating systems. However, the recirculating system is shown inasmuch as the economic and environmental impact of the larger hot water systems used in apartment buildings and commercial complexes is of course greater than a single family residential water system.

The supply or inflow line 18 provides fresh, cool water to the system. It can thus be seen that when there is a high hot water demand, the portions of inflow line 18 adjacent the hot water reservoir will be cooled by the high flow of incoming water, whereas during periods of low use, the static water standing in this pipe will become heated due to conduction (and convection), causing the pipe itself to warm.

Two thermoswitches are used, 20 and 22. The first thermoswitch 20 is designed to open at one temperature, for example 135° (Fahrenheit) and then remain open until a lower temperature is achieved, for example 120° (Fahrenheit). Thus there is a range of temperatures encompassed by this switch in which the switch will not be affected once it is in one mode or the other. The thermoswitch 22 on the other hand, has a single temperature above which the switch will open and below which the switch will close. A typical setting for this thermoswitch will be 100° (Fahrenheit).

These two thermoswitches are wired as shown in series with a solenoid 24 and power supply 26, which would ordinarily be house current. Thus when both thermoswitches 20 and 22 are closed (both in response to a low temperature experienced at their respective pipes) solenoid 24 is activated, throwing the movable switch contact 28 into contact with stationary contact **28*a*, which being in series with now closed 30 connects the motor 33 to the power supply, driving the cam 34 180° which opens switch 30 and permits another switch 32 to close. At the same time motor 33 operates a water temperature control device 36 through a setting means 38** which simply represents some sort of mechanical linkage.

Once this mode has been achieved, it will be seen that the circuit established from power through the motor 33 by virtue of the switch 30 being closed is now opened by virtue of the cam action on that switch, and now cam operated switch 32 is closed. With switch 30 open and switch 32 closed, the motor 33 is deenergized and the movable switch contact 28 is set such that upon deenergization of the solenoid by the opening of either thermoswitches 20 or 22, movable switch contact 28 will be permitted to close into contact with stationary switch contact 28b and re-energize motor 33 for another 180° rotation of the cam 34 and the setting means 38.

The water temperature control device 36 could be a thermostat as was disclosed in U.S. Pat. No. 4,016,402, or it could be an energy gate such as a power switch for an electric heating element or a valve for a gas burner, so that the thermostat has in fact been replaced by the control system rather than having the control system as an add-on.

The operation of the system should be clear from the above description. During periods of high water use, outflow pipes 12 will drop in temperature to the low-set point of thermoswitch 20, thus closing same. The thermoswitch 22 will be also closed as it will be adjacent cold water inflow pipe 18 which will be cooled by inflowing water. Thus with both switches closed, the water temperature control device 36, whether energy gate or thermostat, will be activated to operate the heater in an elevated temperature mode to accomodate the increased hot water needs.

Then demand slackens as at night, supply pipe 18 warms to above the cut-off point of thermoswitch 22 and opens the same, so that the circuit is permanently interrupted until there is another draw on the hot water supply. The thermoswitch 20 will also be open, as the outflow pipe 12 will also warm as an intrisic result of the functioning of a recirculating system (as well as the hot water outlet of a non-recirculatory system).

Figure 2:
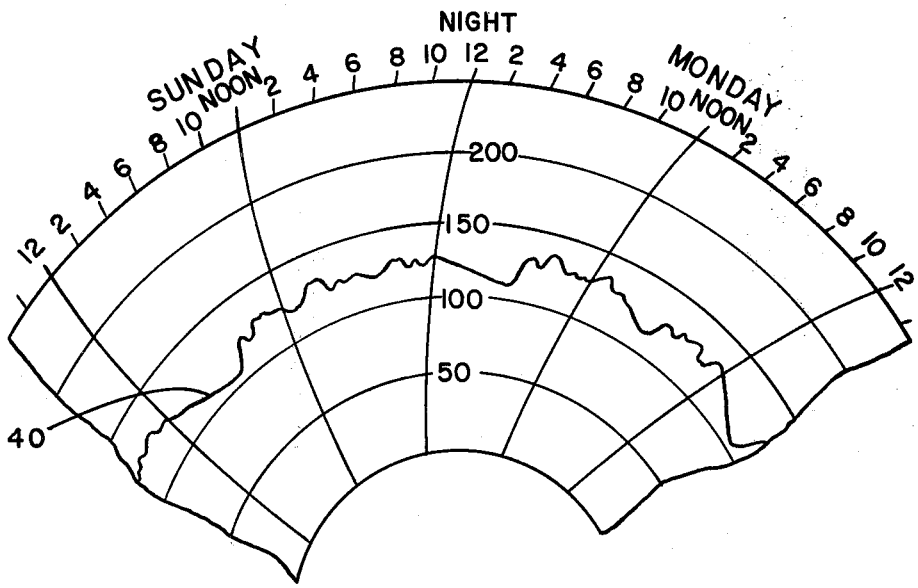
FIG. 2 illustrates a representative portion of an actual temperature graph of a heater controlled by the system.

FIG. 2 is a reproduction of an actual temperature graph recorded over a period of a week, the portion shown including two complete representative days, Sunday and Monday. The system was incorporated into the hot water supply of an operating six unit apartment building.

It can be seen from the graph that just prior to midnight Saturday there was active hot water demand, keeping the water temperature within about a 10° F. range between 125° and 135°. At about midnight, demand slackened and that portion of the graph indicated at 40 represents the gradual but steady lowering of the temperature over an 8 hour period of about 130° to 110°. At about 7:30 a.m., once again demand brought the temperature quickly up to about 132°, and the temperature remained in the heavy use range of 125°–140° until midnight Sunday, when an almost duplicate pattern occurs. The midnight downslope for the entire week in the instant test was almost identical every day to those shown in FIG. 2 except for Friday night, which gave evidence of the return of some midnight rabble-rousers shortly after 2:00 a.m.

The graph shows multiple abrupt temperature rise caused by spurts of use in addition to the regular midnight decline. It is interesting to note that the temperature during heavy use periods is ordinarily maintained within about a 10° variation, which is significantly superior to most conventional control systems.

Thus the system will be able to operate at a much lower temperature during low water demand, conserving radiated and otherwise dissipated and much needed energy, as well as lowering the rate of formation of boiler scale and greatly extending the life of the heating system.

I claim:

1. A water heater control system comprising:

(a) a water heater with a heating means and having a hot water outflow line and a cold water inflow line;

(b) an adjustable water temperature control device operatively connected to said water heater for controlling operation of said heating means;

(c) first temperature sensing means disposed in operable proximity to said outflow line and responsive to the temperature of said outflow line;

(d) a second temperature sensing meand disposed in operable proximity to said inflow line and responsive to the temperature of said inflow line;

(e) electrically operated water temperature control device setting means electrically coupled in circuit with both of said temperature sensing means and mechanically coupled to said water temperature control device, said setting means being, (i) operable for setting said control device in an elevated temperature mode in response to the temperature in said outflow line reaching a predetermined low and the temperature in said inflow line dropping below a predetermined low; and (ii) operable for setting said control device in a reduced temperature mode in response to the temperature in said inflow line exceeding said predetermined low and the temperature in said outflow line exceeding a separately predetermined level above said predetermined low.

2. Structure according to claim 1 wherein said water temperature control device is a thermostat.

3. Structure according to claim 1 wherein said water temperature control device is an energy gate for controlling energization of the heating means of said water heater.

4. Structure according to claim 1 wherein said first and second temperature sensing means are both thermoswitches coupled in series to said control valve setting means.

* * * * *